United States Patent [19]

Bearden

[11] Patent Number: 4,741,668

[45] Date of Patent: May 3, 1988

[54] CENTRIFUGAL PUMP STAGE WITH ABRASION RESISTANT IMPELLER HUB

[75] Inventor: John L. Bearden, Claremore, Okla.

[73] Assignee: Hughes Tool Company, Houston, Tex.

[21] Appl. No.: 108,199

[22] Filed: Oct. 13, 1987

[51] Int. Cl.[4] ..... F04D 29/02

[52] U.S. Cl. ..... 415/212 R; 415/196; 415/199.1

[58] Field of Search ..... 415/199.1, 199.2, 199.6, 415/212 R, 196, 197, 213 R; 416/244 R

[56] References Cited

U.S. PATENT DOCUMENTS

| | | | |
|---|---|---|---|
| 1,365,006 | 1/1921 | Mjolsnes | 415/97 |
| 2,029,333 | 2/1936 | Miller | 415/172 R |
| 3,037,458 | 6/1962 | Olmstead et al. | 415/197 |
| 3,079,866 | 3/1963 | Walker | 415/172 R |
| 3,158,295 | 11/1964 | McConaghy | 415/199.2 |
| 3,269,324 | 8/1966 | Van Atta | 415/199.2 |
| 4,063,846 | 12/1977 | Eagle | 416/244 R |
| 4,479,158 | 2/1985 | Onuma et al. | 415/200 |
| 4,483,660 | 11/1984 | Roberts | 415/199.1 |
| 4,511,307 | 4/1985 | Drake | 415/172 R |
| 4,678,399 | 7/1987 | Vandevier et al. | 415/199.2 |

*Primary Examiner*—Robert E. Garrett
*Assistant Examiner*—John T. Kwon
*Attorney, Agent, or Firm*—James E. Bradley

[57] ABSTRACT

A centrifugal submersible pump has wear resistant features to resist erosion due to sand laden fluid from a well. The pump has diffusers and impellers located within the housing. Each diffuser has a diffuser sleeve with a coaxial bore. The diffuser sleeve is of a material harder than the remaining portions of the sleeve. A hardened lower hub locates slidingly within each diffuser sleeve. The lower hub rotates with the shaft. Each impeller has an upper hub that locates above the lower hub and is also carried by the shaft for rotation with the shaft. The upper hub extends into the bore of the next upward diffuser sleeve. The lower hub is of a material harder than the upper hub and the vane section of the impeller.

3 Claims, 2 Drawing Sheets

CENTRIFUGAL PUMP STAGE WITH ABRASION RESISTANT IMPELLER HUB

CROSS-REFERENCE TO RELATED APPLICATION

This application is being filed simultaneously with another application entitled "Centrifugal Pump Stage With Abrasion Resistant Elements", Mark C. James, which contains some common subject matter.

BACKGROUND OF THE INVENTION

1. Field of the Invention

This invention relates in general to a submersible centrifugal pumps, and in particular to wear resistant elements contained in the pump stages for reducing abrasion.

2. Description of the Prior Art

A submersible centrifugal pump includes a downhole electric motor coupled to a centrifugal pump. The pump has numerous stages of diffusers and impellers that pump fluid to the surface from the well. Normally the impellers and diffusers are made from a cast alloy. The impellers rotate within the difusers, and the mating sliding surfaces are machined smooth to reduce wear and to provide close clearances for sealing. Thrust washers may be located between the impellers and diffusers to accommodate downward and upward thrust.

While these types of pumps are successful, if the fluid being pumped contains a significant amount of entrained sand, the abrasive particles will abrade and/or erode the pump impellers and diffusers, shortening the life of the pump. Normally, a pump needs to be pulled from the well for servicing only every twelve to eighteen months. If the sand has abraded the pump components severely, the pump might have to be pulled earlier than the useful life. The cost for pulling the pump, including lost production time, can be quite expensive, particularly with offshore wells.

U.S. Pat. No. 4,678,399, Vandevier et al, July 7, 1987, and U.S. Pat. No. 4,511,307, Drake, Apr. 16, 1985, show inserts that are attached to the impeller and diffuser. Those inserts are harder than the other portions of the impeller and diffuser to combat wear.

SUMMARY OF THE INVENTION

In this invention, the diffuser has a diffuser sleeve extending upward from the center of the diffuser. The diffuser sleeve has a flange on its upper end and is of a material harder than the remaining portions of the diffuser.

A separate lower hub is carried by the shaft for rotation with the shaft within the diffuser sleeve. The lower hub has an upper end with an external flange. This flange overlies and engages the upper edge of the diffuser flange.

The impeller has an upper hub that is integrally formed with the vane section of the impeller. This upper hub is also carried by the shaft for rotation with the shaft. The upper hub locates within the diffuser sleeve of the next upward stage from the lower hub. The lower end of the upper hub contacts the flange of the lower hub to transmit downward thrust on the impeller to the diffuser sleeve. The lower hub is of a material harder than the impeller vane section and the impeller upper hub.

DESCRIPTION OF THE PREFERRED EMBODIMENT

Figure 1:
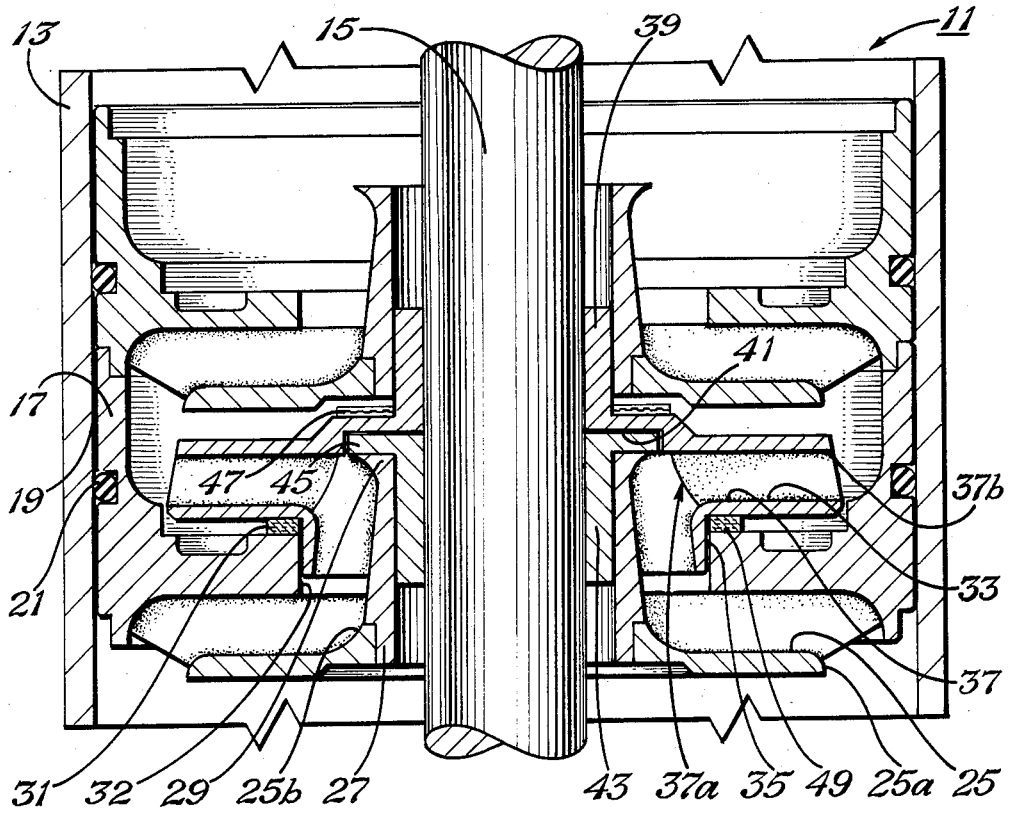
FIG. 1 is a vertical sectional view of a portion of a submersible centrifugal pump constructed in accordance with this invention.

Referring to FIG. 1, pump 11 has a cylindrical housing 13. A shaft 15 extends concentrically through the housing 13 for driving the pump, the shaft 15 being rotated by a submersible electric motor (not shown). The pump 11 has a plurality of pump stages, each stage including a diffuser 17. Diffuser 17 is a tubular metal member having an outer wall 19 that is mounted stationarily inside the housing 13. An O-ring 21 is located between the outer wall 19 of each stage and the housing 13 for sealing.

Diffuser 17 has a number of passages 25. Each passage 25 has an inlet **25*a* at the lower end of the diffuser 17 and located near the outer wall 19. Each passage 25 spirals upward and inward to an outlet 25*b*. Outlet 25*b* is located radially inward from the inlet 25*a***.

Diffuser 17 includes a diffuser hub or sleeve 27. The difuser sleeve 27 is a separate member from the diffuser 17. It is of a harder and more wear resistant material, such as hardened alloy. It is joined at its lower end to the outlet **25*b* so as to be stationary with the diffuser 17. The diffuser sleeve 27 has a flange 29** on its upper end that extends externally outward.

The diffuser 17 further has a guide surface 31 located outward from the diffuser sleeve 27 and about midway along the length of the diffuser sleeve 27. A cylindrical wall 32 joins the guide surface 31.

An impeller 33 is rotatably carried by the shaft 15. Impeller 33 has an inlet portion 35 that extends downward in engagement with the cylindrical wall 32 of the diffuser 17. Each impeller 33 has a vane section that has a plurality of passages 37 extending upward and outward from the inlet portion 35. Each passage 37 has an inlet **37*a* located at the inlet portion 35. Each passage 37 has an outlet 37*b* located at the periphery of the impeller 33**.

The impeller 33 has an upper hub 39 that is carried by the shaft 15. The upper hub 39 is integrally formed with the vane section of impeller 33. The upper hub 39 rotates with shaft 15 by a means of a key (not shown). The upper hub 39 is free to move vertically short distances relative to the shaft 15. The upper hub 39 extends into the diffuser sleeve 27 of the next upward stage. The outer wall of the upper hub 39 slidingly engages the inner bore of the diffuser sleeve 27. An annular recess 41 is located on the underside of the upper hub 39.

A lower hub 43 is carried by shaft 15 below the upper hub 39. The lower hub 43 is carried by the shaft 15 for rotation with the shaft 15 by means of a key (not shown). The lower hub 43 has a flange 45 on its upper end that extends outward. Flange 45 locates within the recess 41.

The lower hub 43 is not physically connected to the upper hub 39 or the impeller 33. However, the lower hub 43 will rotate in unison with the upper hub 39 because both are keyed to the shaft 15. The flange 45 of the lower hub 43 will slidingly engage the upper surface of the diffuser sleeve flange 29. The lower hub 43 is made of a material that is harder and more wear resistant than the upper hub 39 and the remaining portions of the impeller 33. This material is preferably a hardened metal alloy.

A thrust washer 47 is located on the upper side of impeller 33, surrounding the upper hub 39 and located above the recess 41. Another thrust washer 49 is located between the guide surface 31 of the diffuser 17 and the lower side of the vane section of the impeller 33.

In operation, shaft 15 will be rotated by the electric motor (not shown). Shaft 15 rotates each impeller 33. Fluid will flow through the passages 25 and 37 to the surface. As the fluid is discharged from the impellers 33, a downward or upward thrust is created on each impeller 33 depending on the pump's operating point. This thrust is transmitted from the portion of the impeller 33 above recess 41 to the flange 45 of the lower hub 43. The lower hub 43, which is also rotating with the shaft 15, transmits the thrust to the stationary diffuser sleeve 27. The washers 49 do not actually carry any thrust under normal conditions, since the washers are initially set to have a nominal clearance and the thrust will all be handled by the lower hub 45 acting against the diffuser sleeve 27.

Figure 2:
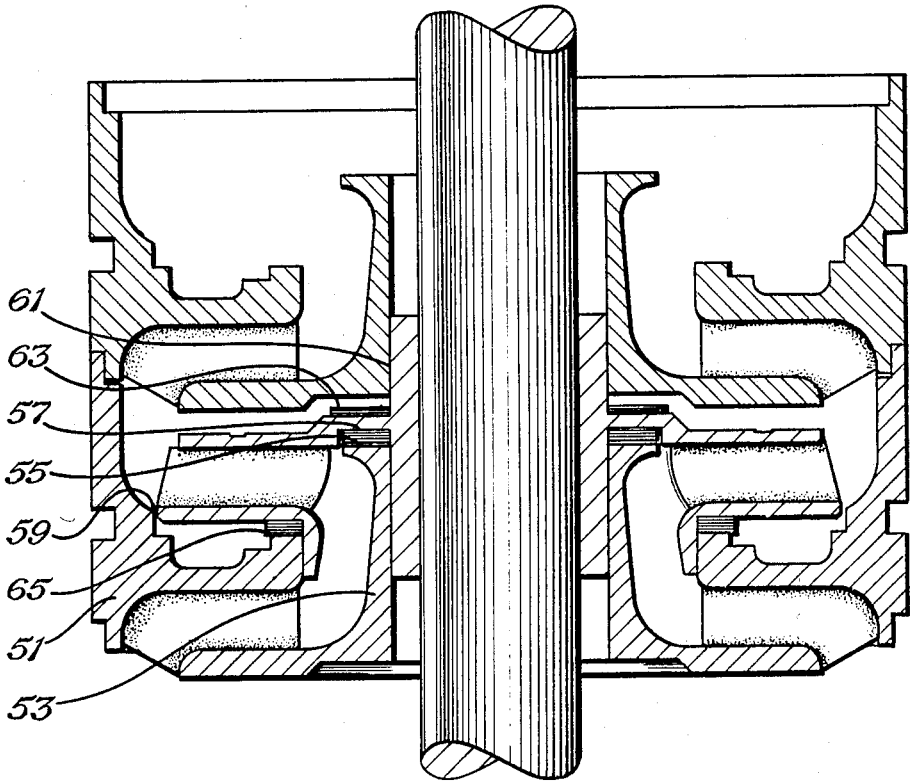
Fig. 2 (PRIOR ART)
FIG. 2 is a sectional view of portions of a prior art conventional pump.

The differences between the invention as shown in FIG. 1 and the prior art is shown in FIG. 2. In FIG. 2, the diffuser 51 has a diffuser sleeve 53 integrally formed with it. The sleeve portion 53 is of the same material as the remaining portions of the diffuser 51, and is not hardened. The diffuser sleeve 53 has a diffuser flange 55 on its upper end which receives thrust washers 57.

The impeller 59 has a hub 61 that is integrally formed with the impeller 59. The hub 61 is of the same material as impeller 59. Thrust washers 63 are located on the impeller 59 immediately above the thrust washers 57 for transmitting any upward thrust that may be encountered. There is also a set of thrust washers 65 to assist in transmitting downward thrust. The thrust washers 65 are located below the impeller vane section.

The invention has significant advantages. Making the diffusers sleeve and the lower hub from hardened materials will extend the life over cast materials. The lower hub prevents the impeller from being subjected to rotational wear from downward axial thrust. The diffuser sleeve and the lower hub also provide hardened wear surfaces for improved radial support and wear resistance.

While the invention has been shown in only one of its forms, it should be apparent to those skilled in the art that it is not so limited, but is susceptible to various changes without departing from the scope of the invention.

I claim:

1. In a submersible centrifugal pump of the type having a housing, a drive shaft extending through the housing, a plurality of stages, each stage having a diffuser containing a plurality of passages and an impeller, each impeller having a vane section containing a plurality of passages, the improvement comprising:

a diffuser sleeve located in a central portion of the diffuser, and having an axial bore coaxial with the axis of the shaft, the diffuser sleeve being of a material harder than the remaining portions of the diffuser and having an upper edge;

a lower hub carried by the shaft for rotation with the shaft within the bore of the diffuser sleeve, the lower hub having an upper end with an external flange, the flange overlying and engaging the upper edge of the diffuser sleeve;

the impeller having an upper hub integrally formed with the vane section and carried by the shaft for rotation with the shaft within the bore of a diffuser sleeve of a next upward stage from the lower hub, the lower end of the upper hub contacting the flange of the lower hub to transmit downward thrust on the impeller to the diffuser sleeve within which the lower hub is carried; and the lower hub being of a material harder than the impeller vane section and the upper hub.

2. In a submersible centrifugal pump of the type having a housing, a drive shaft extending through the housing, a plurality of stages, each stage having a diffuser containing a plurality of passages and an impeller, each impeller having a vane section containing a plurality of passages, the improvement comprising:

a diffuser sleeve extending upward from a central portion of the diffuser and having an axial bore, the diffuser sleeve being of a material harder than the diffuser and having an external flange on its upper end;

a lower hub carried by the shaft for rotation with the shaft within the bore of the diffuser sleeve, the lower hub having an upper end with an external flange, the lower hub flange overlying and engaging the flange of the diffuser sleeve;

the impeller having an upper hub integrally formed with the vane section and carried by the shaft for rotation with the shaft within the diffuser sleeve of a next upward stage from the lower hub, the impeller having an annular recess formed below the upper hub, the flange of the lower hub being located within the recess to transmit downward thrust on the impeller to the diffuser sleeve within which the lower hub is located; and the lower hub being formed of a material harder than the impeller vane section and the upper hub.

3. A submersible centrifugal pump, comprising in combination:

a housing;

a drive shaft extending through the housing;

a plurality of diffusers mounted stationarily in the housing, each diffuser having a plurality of passages;

each diffuser having a diffuser sleeve extending upward from a central portion of the diffuser and having a bore coaxial with the axis of the shaft, the diffuser sleeve being of a material harder than the remaining portions of the diffuser;

a plurality of lower hubs, each lower hub being carried by the shaft for rotation by the shaft within one of the diffuser sleeves, each lower hub having an upper end with an external flange, the lower hub flange overlying and engaging the flange of one of the diffuser sleeves;

a plurality of impellers, each impeller having a vane section containing a plurality of passages;

each impeller having an upper hub integrally formed with the vane section and carried by the shaft for rotation with the shaft within a diffuser sleeve of the next upward diffuser from the lower hub, the lower end of the upper hub of each impeller contacting the flange of one of the lower hubs to transmit downward thrust on the impeller to one of the diffuser sleeves; and the lower hub being of a material harder than the impeller vane section and the upper hub.

* * * * *